US006467635B1

(12) United States Patent
McComb et al.

(10) Patent No.: US 6,467,635 B1
(45) Date of Patent: Oct. 22, 2002

(54) PORTABLE CASKET DISPLAY APPARATUS

(76) Inventors: David W. McComb, 1140 Lake Ave., Fort Wayne, IN (US) 46805; Walter A. McComb, Jr., 1140 Lake Ave., Fort Wayne, IN (US) 46805

( * ) Notice: Subject to any disclaimer, the term of this patent is extended or adjusted under 35 U.S.C. 154(b) by 0 days.

(21) Appl. No.: 09/908,408

(22) Filed: Jul. 18, 2001

(51) Int. Cl.[7] ..... A47F 7/00

(52) U.S. Cl. ..... 211/85.16; 211/90.02; 211/175; 211/193; 211/182

(58) Field of Search ..... 211/85.16, 175, 211/189, 187, 186, 182, 193, 90.02

(56) References Cited

U.S. PATENT DOCUMENTS

| | | | | |
|---|---|---|---|---|
| 1,169,157 | A | | 1/1916 | Honold |
| 1,510,972 | A | * | 10/1924 | Beam |
| 1,841,412 | A | | 1/1932 | Leicht |
| 1,966,751 | A | * | 7/1934 | Brefeld |
| 2,937,768 | A | | 5/1960 | Davis |
| 3,285,444 | A | * | 11/1966 | Reilly |
| 3,353,888 | A | * | 11/1967 | Pritelli |
| 3,371,454 | A | * | 3/1968 | Anderson |
| 3,513,606 | A | * | 5/1970 | Jones |
| 3,534,517 | A | * | 10/1970 | Kahn |
| 3,901,612 | A | * | 8/1975 | Canin |
| 4,653,652 | A | * | 3/1987 | Avati ..... 211/189 |
| 5,524,394 | A | | 6/1996 | Szabo, Sr. et al. |
| 5,797,499 | A | | 8/1998 | Pinco |
| 5,848,498 | A | | 12/1998 | Szabo, Sr. et al. |
| D404,884 | S | | 1/1999 | Salatin et al. |
| 5,901,862 | A | | 5/1999 | Riga et al. |
| 5,901,863 | A | | 5/1999 | Riga et al. |
| 5,960,966 | A | | 10/1999 | Riga et al. |
| 6,073,320 | A | | 6/2000 | Salatin et al. |
| D448,135 | S | * | 9/2001 | Petro |

* cited by examiner

*Primary Examiner*—Robert W. Gibson, Jr.
(74) *Attorney, Agent, or Firm*—Susan L. Firestone; Paul W. O'Malley

(57) ABSTRACT

The portable display apparatus of the invention is used to display caskets, urns, burial vaults and related materials. The portable casket display apparatus is made from a number of extrusions which have channels along the extrusion exterior. The display apparatus has a pair of vertical back extrusions releasably connected to first and second horizontal rear extrusions in a spaced apart relationship. Upper and lower pairs of lateral extrusions releasably connect to the vertical back extrusion in a spaced apart relationship. A sliding mechanism attaches to each lower lateral extrusion in a channel to move a bottom casket support from beneath the upper casket support.

15 Claims, 3 Drawing Sheets

PORTABLE CASKET DISPLAY APPARATUS

BACKGROUND OF THE INVENTION

1. Field of the Invention

The present invention relates to a portable casket display apparatus.

2. Description of the Prior Art

In the funeral industry, people choosing caskets often want to see both the exterior and the interior of the casket. The caskets, however, are heavy and large, often weighing over 150 pounds with a length over five feet long. Displaying a full inventory of caskets requires a large area. Otherwise, the inventory must be stored offsite and people must choose from photographs.

Thus a need exists to increase the number of caskets shown in a space. Using quarter sized caskets or quarter cut is well known in Europe to show both the interior and exterior design. Because only a quarter of the casket is used, more caskets are displayed in the same amount of space.

Another way to increase the number of caskets in a limited space involves stacking caskets on display racks. U.S. Pat. No. 1,841,412 discloses a two tiered casket display rack using brackets bolted to tubular posts. A lower casket sits on extension arms with one pair of rollers fixed to the front of the extension arms. In the fully retracted position the front rollers are above the floor. To pull out the lower casket for viewing, the extension arms ride on bearings until the weight of the casket forces the front rollers onto the floor. To retract, the heavy casket must be rolled off the floor back onto the extension arms. The weight of the bottom casket helps support the weight of the top casket. When the bottom casket is retracted, the weight rests on the arms. When the casket moves outward, the weight shifts forward, destabilizing the display apparatus.

U.S. Pat. No. 2,937,768 discloses another two-tiered rack with a solid steel C-shaped frame. The top casket rests on the frame, while the bottom casket rests on a wheeled dolly. To see the lower casket in this arrangement, the bottom casket slides out on the dolly using a scissors mechanism. To avoid jamming the scissors mechanism from lateral drift and/or rotation, the casket must be properly guided. Also the scissors mechanism must be manipulated manually, usually by applying pressure to the lower casket itself.

Another scissors retractable mechanism is disclosed in U.S. Pat. No. 5,405,017. The '017 patent discloses a casket display apparatus with two side walls connected to a back panel or wall. The '017 patent includes a two-tiered free-standing casket display rack with the lower rack retractable by a scissors mechanism connected to a rod. The upper rack has steel rails welded to vertical posts at the extreme back ends. The '017 display apparatus provides no structural support for the display rack. Although the modular display panels are "portable", the rack itself is not.

Like '017, U.S. Pat. No. 5,901,862 uses a modular casket display apparatus with two side walls connected to a back panel or wall. These walls are weight bearing and support the display apparatus. The back wall and side walls support a retractable lower display rack. With wall panels 5 to 7 feet tall and a back wall length greater than a casket, the display apparatus is neither lightweight nor portable.

The need exists for a portable display apparatus to show a larger number of caskets for the prospective buyer. In addition, the need exists for a display that is truly portable, lightweight and easily assembled than the prior art casket displays.

SUMMARY OF THE INVENTION

The present invention relates to a portable display apparatus for displaying caskets, urns, burial vaults and related materials. The portable casket display apparatus is made from a number of extrusions having channels extending longitudinally along the length of their exterior. One display apparatus has a pair of vertical back extrusions releasably connected to first and second horizontal rear extrusions in a spaced apart relationship. Upper and lower pairs of lateral extrusions releasably connect to the vertical back extrusion in a spaced apart relationship. A sliding mechanism attaches to each lower lateral extrusion in a channel facing inward. A bottom casket support releasably connects to the sliding mechanism.

Another casket display apparatus has a pair of vertical back extrusions releasably connected to first and second horizontal rear extrusions in a spaced apart relationship. Upper and lower pairs of lateral extrusions releasably connect to the vertical back extrusion in a spaced apart relationship. A horizontal front extrusion releasably connects to the upper pair of lateral extrusions, while a pair of vertical front extrusions releasably connects to the front extrusion and the lower pair of lateral extrusions. Each extrusion has an exterior channel extending longitudinally along its length.

Additional effects, features and advantages will be apparent in the written description that follows.

DETAILED DESCRIPTION OF THE INVENTION

Figure 1:
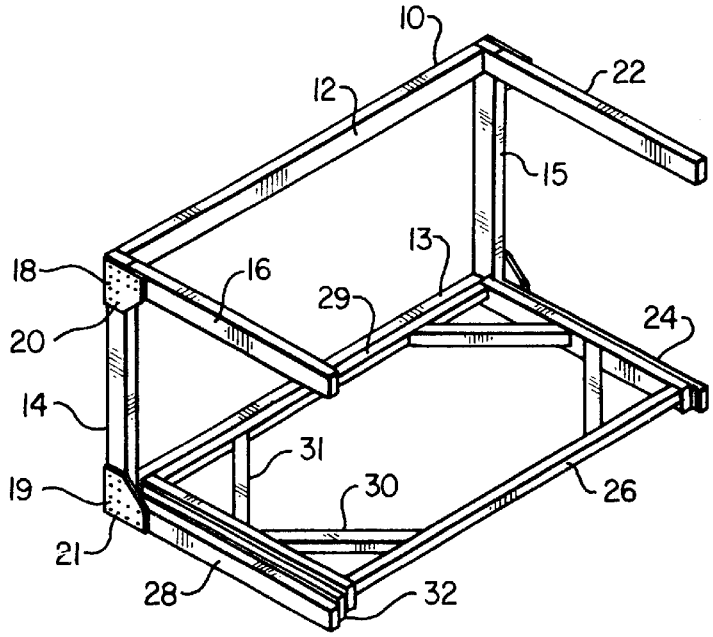
FIG. 1 is a perspective view of a portable casket display apparatus of the invention.

Turning to the figures, where like numbers refer to like structures, the portable casket display of the invention has a frame made from extrusions with longitudinal channels. The portable casket display shown in FIGS. 1 and 2 has frame 10 with first and second horizontal rear extrusions 12, 13. A pair of vertical back extrusions 14, 15 releasably connect to first and second horizontal rear extrusions 12, 13 in a spaced apart relationship, preferably at the top and bottom. Upper and lower pairs of lateral extrusions 16, 17 releasably connect to the vertical back extrusions 14, 15 in a spaced apart relationship using joining plates 18, 19 fastened with bolts 20, 21. Upper lateral extrusions 16 form upper rack 22, which may have a shelf, if desired. Inward facing channel 24 runs longitudinally along the extrusion's exterior of the lower pair of lateral extrusions 17.

Bottom rack 26 is designed to fit between the lower pair of lateral extrusions 17 and is typically rectangular. Rack extrusions 28, 29 releasably connect at the corners. Braces 30, 31 can span rack extrusions 28, 29 at the corners for additional support. Bottom rack 26 attaches to sliding mechanism 32. Bottom rack 26 can have casters mounted onto rack extrusions 28, 29, if desired.

Sliding mechanisms typically support at least 150 pounds of weight when the bottom rack is loaded. Sliding mechanism 32 is a heavy duty drawer slide, such as a telescoping drawer slide available from various furniture hardware manufacturers, such as Accuride or Hettich. Sliding mechanism 32 attaches directly to the lateral extrusion 17 in channel 24. A second portion of sliding mechanism 32 connects to an inner rack channel 34 in rack extrusion 28.

Figure 3:
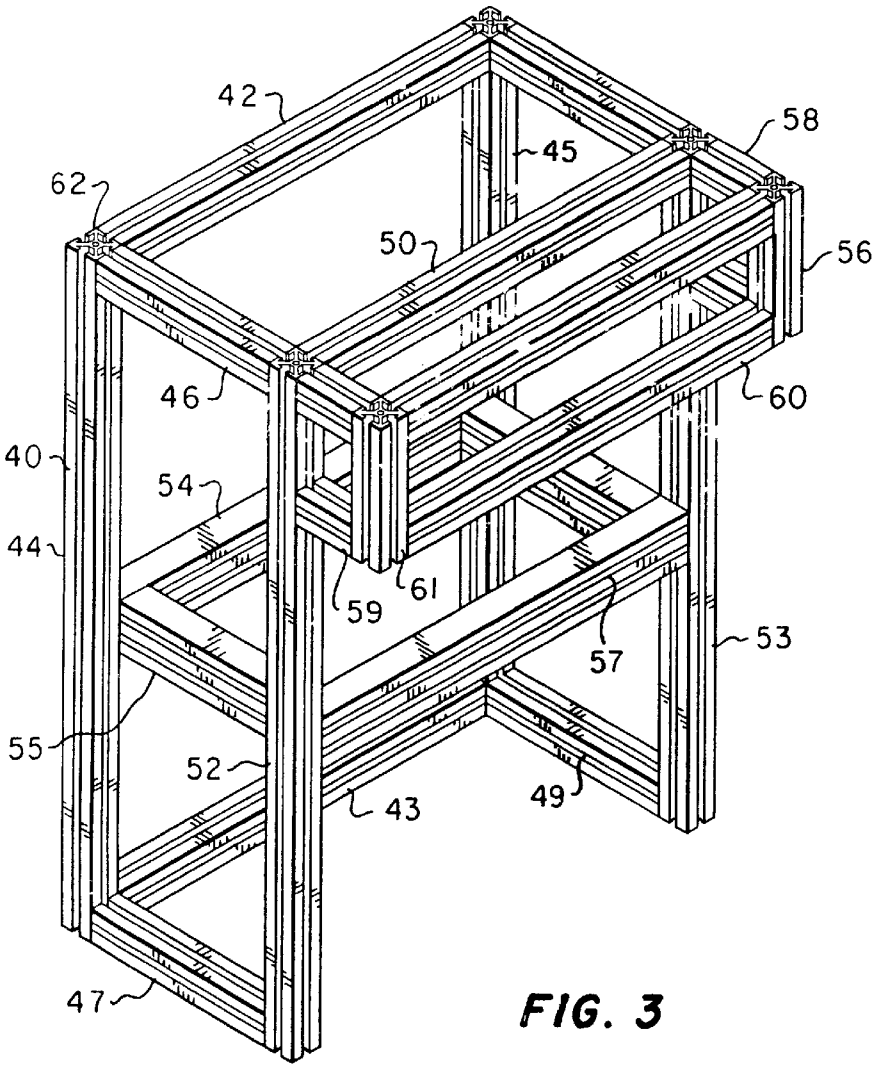
FIG. 3 is a perspective view of a portable casket display apparatus of the invention without a bottom rack.

In the embodiment shown in FIG. 3, frame 40 has first and second horizontal rear extrusions 42, 43, preferably at the top and bottom of frame 40. A pair of vertical back extrusions 44, 45 releasably connect to the first and second horizontal rear extrusions 42, 43 in a spaced apart relationship. Upper and lower pairs of lateral extrusions 46, 47 releasably connect to the vertical back extrusions 44, 45 in a spaced apart relationship at the top and bottom of frame 40. Channels 48, 49 run longitudinally along the exterior sides of the extrusions in the frame 40. Horizontal front extrusion 50 releasably connects to an upper pair of lateral extrusions 46, preferably at the top. A pair of vertical front extrusions 52, 53 releasably connects front extrusion 50 and lower lateral extrusions 47 in a spaced apart relationship. If desired, leveling feet can be secured to the bottom of vertical extrusions 44, 52.

An upper casket can rest directly on shelf supports 57, such as casket extrusions 54, 55 attached to vertical extrusions 44, 45, 52, 53 at inner channels 48. If desired, a shelf can be placed on the casket extrusions. Alternatively, brackets can be attached to the vertical extrusions and a shelf placed on the brackets.

As discussed above, a lower casket can rest directly on bottom rack 26. Bottom rack 26 fits between the lower pair of lateral extrusions 47 and slides from beneath the upper casket with sliding mechanism 32. In this case, the bottom rack is attached to a heavy duty drawer slide.

Valence 56 releasably attaches to the pair of vertical front extrusions 52, 53. Valence 56 is preferably made with upper and lower pairs of side valence extrusions 58, 59. Pairs of horizontal and vertical valence extrusions 60, 61 attach to the side valence extrusions 58, 59. Valence extrusions preferably have channels 48, 49.

The extrusions are preferably aluminum or aluminum alloy and are T-slotted along the length of the exterior sides. The extrusions are preferably rectangular in cross-section and can be square in cross-section. These extrusions have a plurality of T-slotted channels 68, 69 for use with fasteners as described below to releasably connect one extrusion with another extrusion. Appropriate aluminum extrusions are available from 80/20, Inc. (Columbia City, Ind.).

Figure 2:
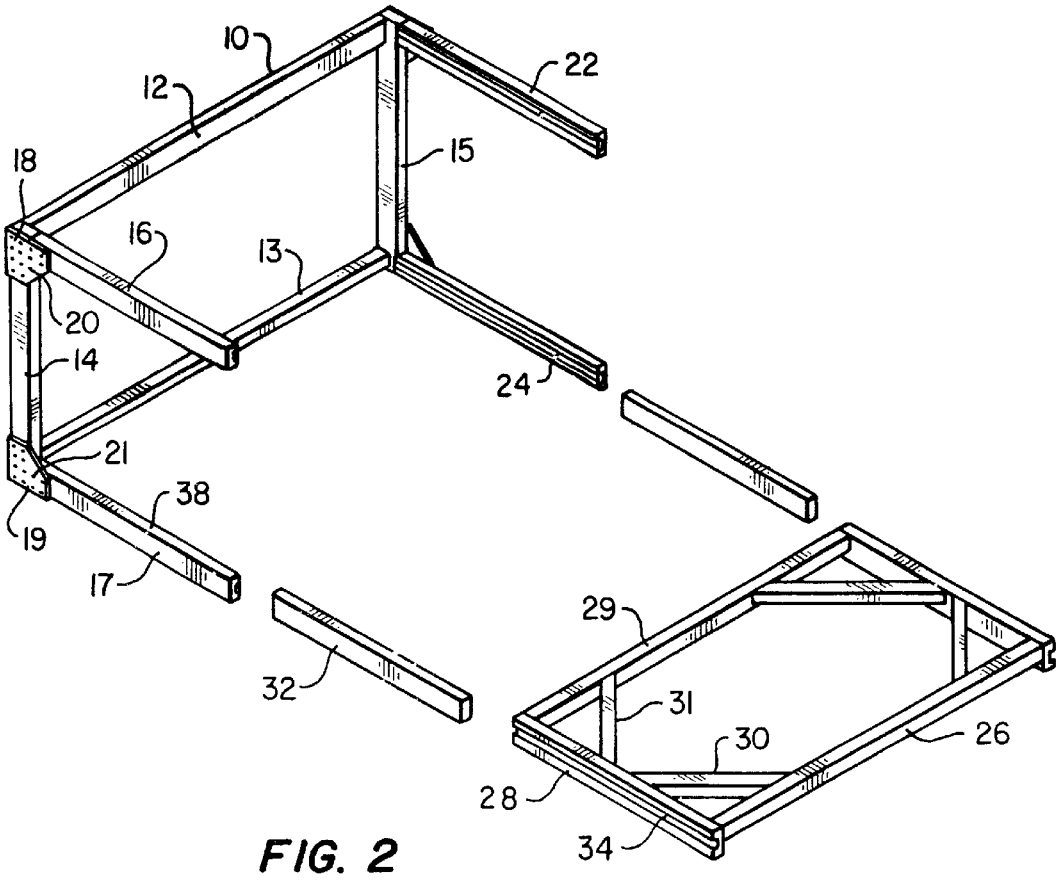
FIG. 2 is an exploded perspective view of the portable casket display apparatus shown in FIG. 1.
Figure 4:
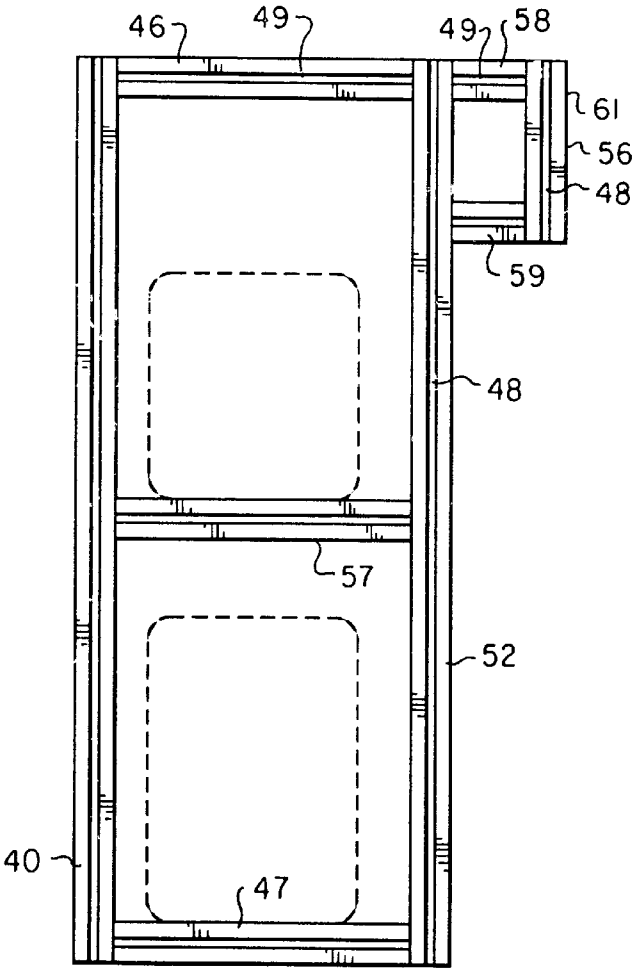
FIG. 4 is side view of a portable casket display apparatus of the invention with a bottom rack and caskets shown with phantom lines.

Preferably the extrusions are releasably connected by any fastening means, such as joining plates, anchor fasteners, butt connectors, T-bolts and T-nuts, brackets, screws, gussets, and the like. For example, FIGS. 1 and 2 show joining plate 18 bolted into the T-slotted channels of vertical back extrusions 14 and side extrusions 16 while FIG. 3 shows horizontal extrusion 46 butt connected to vertical extrusion 42 with a butt connector.

For aesthetic purposes, end caps 62 attach to the exposed ends of the extrusions 44, 52. End cap 62 fastens to the center canal 70 of the extrusion 44 using push-in T-bolts. T-slot covers can also be installed into the T-slotted channels, if desired.

Figure 6:
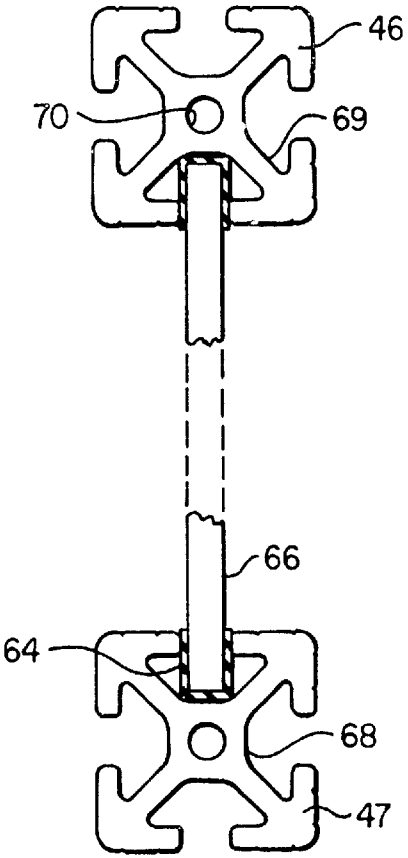
FIG. 6 is a partial cross-sectional view of the casket display apparatus with a panel held in an extrusion channel.

Panels, curtains, draperies and the like can be installed to the frame. Attractive fabrics, for example, can hang from hooks within the channels. Panels can insert directly into the channel. Or if desired as shown in FIG. 6, panel gasket 64 can attach to panel 66 before insertion into T-slotted channel 68 in the upper and lower horizontal extrusions. Alternatively, panel retainers or mounting brackets can be inserted into the extrusion channels before introducing a panel. One or more panels can slide into a panel retainer for a decorative display. Similarly, panels can slide into the channels of the valence extrusions. Because the panels are not weight bearing, they do not need to be one piece. The panels can be lightweight and in multiple parts that readily assemble together.

Figure 5:
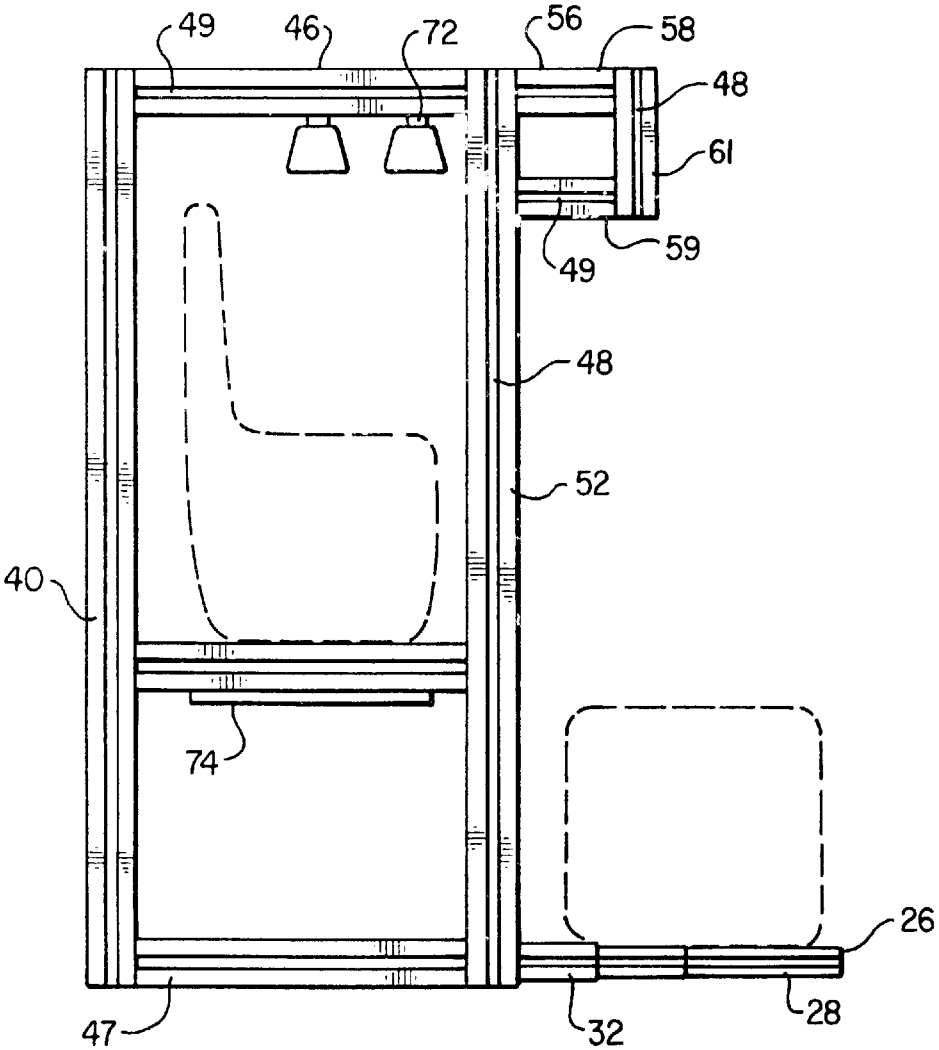
FIG. 5 is side view of a portable casket display apparatus of the invention with a bottom rack extended and caskets shown with phantom lines.

The extrusions can hide unsightly hardware. Display lights are often used to illuminate the caskets. Electrical wiring for the display lights can be threaded through either the center canal or wiring ducts within the channels. Fixtures for the display lights can also be connected to the channels of the extrusions to allow the use of spotlights, such as track lighting 72, or fluorescent lighting 74 for illuminating the displayed casket (FIG. 5.).

The portable casket display apparatus of the invention has a number of advantages. The portable casket display is light weight. Aluminum and its alloys weigh only about one-third as much as steel with which many of the racks are made. Aluminum also has a higher strength-to-weight ratio than steel.

The portable casket display apparatus of the invention is easily disassembled and reassembled. The frame uses plates, connectors, T-bolts, and the like, to releasably connect the light weight extrusions. The use of channels and the connectors allows easy alignment and assembly of the constituent parts of the frame. Because bolts and nuts are frequently used in the channels, there is no need to align them with drilled holes. Tubular steel posts, however, either require welding to hold the components together or holes drilled into the tubing. Forming a stable structure allows no room for error when fastening a bolt in a tubular post. Holes must be exactly aligned in tubular steel in order to fasten correctly.

Being lightweight and portable, the frame is less expensive and less time consuming to assemble. If desired, the frames can be reassembled into different configurations, with the racks placed in different locations or additional racks used. The lightweight extrusions are also easy to carry. Therefore, the portable casket display apparatus of the invention can be used in a preview room or in a temporary display area.

The apparatus of the invention includes multiple components used together to form a "curtain wall" frame. Because the frame is weight bearing, decorative panels can be light weight and in pieces. Curtains or drapery can also be used to enhance the display of the burial products and the display spaces. In addition, the portable casket display apparatus may be useful for displaying items outside of the funeral home, such as a trade show.

While the invention is shown in only one of its forms, it is not thus limited but is susceptible to various changes and modifications without departing from the spirit and scope of the invention.

What is claimed is:

1. A portable casket display apparatus, comprising:

first and second horizontal rear extrusions;

a pair of vertical back extrusions releasably connected to the first and second horizontal rear extrusions in a spaced apart relationship;

upper and lower pairs of horizontal lateral extrusions releasably connected to the vertical back extrusions in a spaced apart relationship;

channels extending along the length of the exterior of each extrusion, wherein each lower lateral extrusion has a channel facing inward;

a sliding mechanism attached to each lower lateral extrusion in the inward facing channel; and a bottom casket rack releasably attached to the sliding mechanism.

2. A portable casket display apparatus of claim 1, wherein each extrusion releasably connects by fasteners.

3. A portable casket display apparatus of claim 2, wherein each channel is T-slotted.

4. A portable casket display apparatus of claim 3, wherein each extrusion is made of aluminum or aluminum alloys.

5. A portable casket display apparatus of claim 4, further comprising:

a panel inserted into opposite channels of opposing pairs of extrusions.

6. A portable casket display apparatus, comprising:

first and second horizontal rear extrusions;

a pair of vertical back extrusions releasably connected to the first and second horizontal rear extrusions in a spaced apart relationship;

upper and lower pairs of horizontal lateral extrusions releasably connected to the vertical back extrusions in a spaced apart relationship;

a horizontal front extrusion releasably attached to the upper pair of lateral extrusions;

a pair of vertical front extrusions releasably connected to the horizontal front extrusion and the lateral extrusions;

channels extending longitudinally along the length of the exterior of each extrusion;

shelf supports connected to the vertical extrusions;

a sliding mechanism attached to each lower lateral extrusion in a channel facing inward; and a bottom rack releasably connected to the sliding mechanism.

7. A portable casket display apparatus of claim 6, wherein the bottom rack is a rectangular frame of releasably connected extrusions.

8. A portable casket display apparatus of claim 7, wherein each extrusion releasably connects by fasteners.

9. A portable casket display apparatus of claim 8, further comprising:

a panel inserted into opposite channels of opposing pairs of extrusions.

10. A portable casket display apparatus of claim 9, wherein each channel is T-slotted.

11. A portable casket display apparatus of claim 10, further comprising:

a valence of extrusions releasably connected to the upper horizontal front extrusion.

12. A method of assembling a casket display apparatus, the steps comprising:

providing first and second horizontal rear extrusions;

releasably connecting in a spaced apart relationship a pair of vertical back extrusions with the first and second horizontal rear extrusions;

releasably connecting in a spaced apart relationship a lower pair of horizontal lateral extrusions with the vertical extrusions;

releasably connecting a horizontal front extrusion to an upper pair of lateral extrusions;

releasably connecting a pair of vertical front extrusions to the horizontal front extrusion and the lateral extrusions;

attaching a sliding mechanism to each lower lateral extrusion in a channel facing inward;

releasably connecting a bottom rack to the sliding mechanism;

attaching shelf supports to the vertical extrusions; and wherein each extrusion has channels extending longitudinally along the length of the extrusion.

13. A method of assembling a portable casket display apparatus of claim 12, wherein each extrusion releasably connects by fastening into the channels.

14. A method of claim 13, further comprising the step of:

inserting a panel into opposite channels of opposing pairs of extrusions.

15. A method of claim 14, wherein each channel is T-slotted.

* * * * *